United States Patent [19]

Dinello

[11] 4,200,498

[45] Apr. 29, 1980

[54] PRESSURE RELIEVING COKE OVEN DOOR

[75] Inventor: Julio G. Dinello, Elizabeth, Pa.

[73] Assignee: United States Steel Corporation, Pittsburgh, Pa.

[21] Appl. No.: 922,713

[22] Filed: Jul. 7, 1978

[51] Int. Cl.[2] ..... C10B 25/06; C10B 25/16

[52] U.S. Cl. ..... 202/248; 110/173 R; 202/268

[58] Field of Search ..... 202/242, 247, 248, 268; 110/173 R

[56] References Cited

U.S. PATENT DOCUMENTS

| | | | |
|---|---|---|---|
| 2,236,092 | 3/1941 | Freeman | 202/248 |
| 2,275,400 | 3/1942 | Koppers | 202/248 |
| 2,338,675 | 1/1944 | Van Ackeren | 202/248 |
| 2,855,347 | 10/1958 | Cellan-Jones | 202/248 |
| 2,993,845 | 7/1961 | Coe | 202/248 |
| 3,505,174 | 4/1970 | Peterson et al. | 202/248 |
| 4,118,284 | 10/1978 | Bowman et al. | 202/248 |

FOREIGN PATENT DOCUMENTS

| | | | |
|---|---|---|---|
| 2317581 | 10/1974 | Fed. Rep. of Germany | 202/248 |

*Primary Examiner*—Michael S. Marcus
*Attorney, Agent, or Firm*—William L. Krayer

[57] ABSTRACT

A coke oven door having a refractory plug with vertical gas channels on each side, each channel having a plurality of tributary vents originating at the face of the plug normally exposed to a relatively high pressure area and leading upwardly to the vertical gas channels at about a 30° angle to permit reduction of the gas pressure through the channels, behind the door seal.

4 Claims, 4 Drawing Figures

PRESSURE RELIEVING COKE OVEN DOOR

BACKGROUND OF THE INVENTION

The problems of adequately sealing coke oven doors are well known and highly publicized. Coke oven doors are necessarily located in harsh and demanding environments. They are subject to extremes of temperature and to virtually unavoidable abuse as they are removed and relocated during the continuous cycles of coke making. Many types of doors and seals therefor have been tried through the years in attempts to contain the noxious coke oven gas and to prevent the buildup of deposits therefrom around the periphery of the seal. Deposits from the coke oven gas tend to harden, complicating the problems of obtaining adequate sealing.

As a rule, the atmospheric pressure within the heated coke oven during the coke making process is considerably higher than pressures immediately outside. The pressure drop in the area of a leak, therefore, contributes significantly to the tendency of materials in the coke oven gas to form deposits in the immediate area of the leak, which generally will be in the seal area. Where such deposits are formed, they will render it even more difficult to obtain a good seal on succeeding cycles. It is desirable, therefore, to reduce the pressure drop across leaks in the seal, in order to minimize undesirable depositions from escaping gas.

It is also desirable to reduce significantly the difference in pressure across any leaks in the seal in order to reduce the volume of noxious gas liable to escape, since the flow rate of gas will tend to increase exponentially with the pressure difference.

The reader may be interested in reviewing U.S. Pat. No. 2,275,400 which employs vertical gas channels at the sides of the plug, and U.S. Pat. No. 2,855,347, which includes a central gas channel having feeder ducts inclined upwardly from communication with the oven. Neither of these disclosures, however, accomplishes a decrease in pressure over substantially the entire both sides of the door.

SUMMARY OF THE INVENTION

I have devised a coke oven door which significantly reduces the pressure drop through an imperfect seal thereon, thus significantly reducing the volume of gas which will tend to escape through any seal leaks which may exist, and reducing the quantity and incidence of deposits from the gas, which deposits tend to make sealing increasingly difficult.

My invention comprises a coke oven door of more or less conventional size and shape and having conventional seal means, but containing a plug, preferably of refractory material, of the entire length of the door, providing vertical gas channels on each side and fed by tributary channels slanting downward at an angle between about 15° and 45° from the channels to communicate with the oven cavity. The channels are preferably centered about one-third of the distance from the door side of the plug to the face, but may be centered from about one-fourth to one-half of the distance. They should have a channel area (cross-section) of at least about three square inches and are preferably semi-circular.

The tributaries should be present throughout the length of the channels, i.e. at least three tributaries from every two feet of channel; however, more than two tributaries per foot are not necessary and will tend to weaken the refractory.

Referring now to the drawings.

Figure 1:
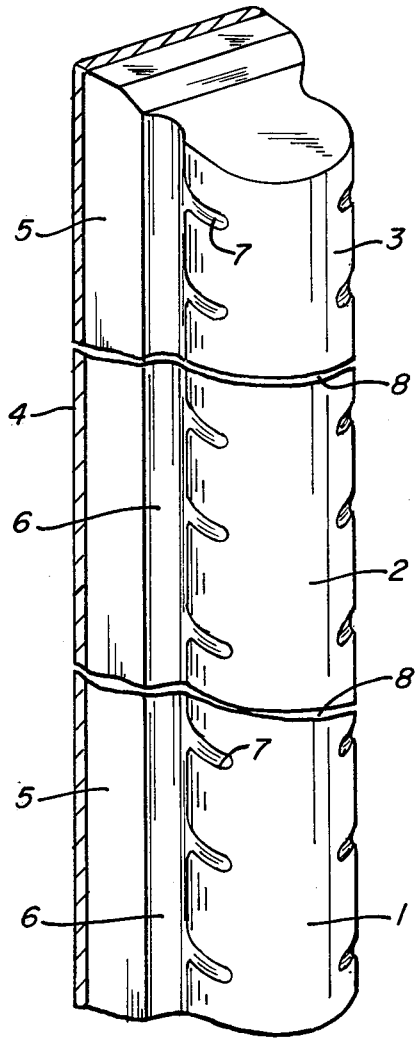
FIG. 1 is a perspective view of the plug side of my coke oven door.
Figure 3A:
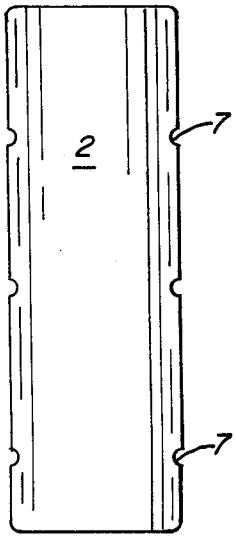
Figure 3B:
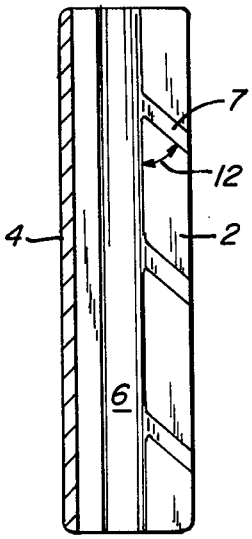

FIGS. 3*a* and 3*b* are the front and side views of the center of the specific refractory unit shown in FIG. 1.

In FIG. 1, the refractory plug is shown in three sections—a bottom section 1, center section 2, and top section 3, all of which are mounted on steel plate 4, which is adapted by means not shown to be fastened to the latching, sealing, and other conventional parts of the outside of the door. The refractory shape exhibits on each side an outer abutment 5, a vertical gas channel 6, and a plurality of gas tributaries 7. Because of the slight tapering and curvature of the plug toward the oven (seen more clearly in FIG. 2), the tributaries 7 running along the side of the plug may terminate in communication with the oven without running the full distance to the extreme depth of the plug. The use of expansion spaces 8 is recommended.

Figure 2:
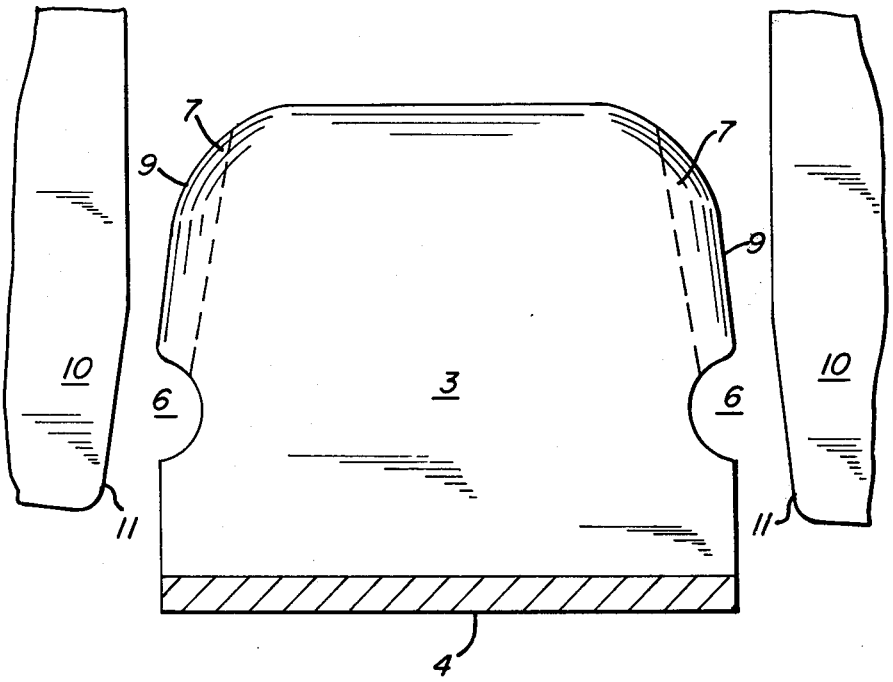
FIG. 2 is a top view of the door in place.

Referring now to FIG. 2, it may be seen that channels 6 are centered at a point between about ¼ and ½ the distance from the plate 4 so they will be in a position to alleviate internal pressures as near to the outer periphery of the door as practical without actually creating an opening to the outside. It may also be seen that the perimeter of the refractory shape is slightly tapered near the oven face, i.e. behind the channel at 9, and that the oven wall 10 is shown in the more or less conventional tapered shape at 11, although this tapering is not essential. The position of channel 6 is such that it directs the passage of the gas upwardly approximately at the point of restriction before it communicates with the periphery of the plate 4.

FIG. 3*a* is an elevational view of center portion 2 of the refractory plug, from the hot side of the door; the side view 3*b* shows column 6 connected to tributaries 7 set at approximately 30° angles.

Table I shows the results of the use of my doors on two ovens in the same battery over a number of weeks. If any smoke at all escapes from the door, it is counted as a leak. Sealing times measure the time from the closing of the door to the time when smoke no longer escapes. At the end of week C, by dividing the number of cycles into the number of zero leaks, it will be seen that the doors yield, respectively, 80% and 76% zero leaks, an extraordinary result, as will be appreciated by persons skilled in the art.

TABLE I

| Week | Door | Cumulative Cycles Observed | Range Sealing Times, Min. | Mean Sealing Times, Min. | Median Sealing Times, Min. | No. Zero Leaks |
|---|---|---|---|---|---|---|
| A | 1 | 74 | 0–180 | 9 | 0 | 58 |
| | 2 | 69 | 0–30 | 4 | 0 | 56 |
| B | 1 | 89 | 0–180 | 8 | 0 | 72 |
| | 2 | 85 | 0–1020 | 19 | 0 | 66 |
| C | 1 | 92 | 0–180 | 8 | 0 | 74 |
| | 2 | 87 | 0–1020 | 19 | 0 | 66 |
| D | 1 | 109 | 0–560 | 12 | 0 | 87 |
| | 2 | 97 | 0–1020 | 47 | 0 | 68 |

The flow of gas from the top of the channels may be directed through overhead ducts (not shown) and/or standpipes or to facilities for collecting valuable components and/or for pollution abatement purposes, by means known in the art.

My invention is applicable equally to doors on the coke side or on the pusher side of the oven. While I have illustrated the invention as typically employing refractory plugs, other materials may be used.

I claim:

1. A coke oven door comprising a vertically extended door plate and a plug thereon of substantially the area of said vertically extended plate, said plug being substantially monolithic and having vertically disposed gas channels extending along the length thereof, said vertically disposed channels being formed in the sides of said plug so that each of said vertical channels is exposed to and communicates with the interior of the coke oven along its entire length, each vertical gas channel communicating with and connected to a plurality of tributary channels, said tributary channels being formed in the respective sides of said plug so that each tributary channel is exposed to and communicates with the interior of the coke oven chamber, each of said tributary channels extending along the side of said plug toward the oven face of said plug and downwardly to form an angle of between about 15° and 45° with said vertical channels.

2. The door of claim 1 wherein there are at least three tributaries for each two feet of channel.

3. The door of claim 1 wherein the plug comprises a plurality of sections and is provided with expansion spaces between said sections.

4. The door of claim 1 in which the vertical gas channels are located between about one-fourth and one-half the distance from the door plate to the back of the plug.

* * * * *